US006321906B1

(12) United States Patent
Wein

(10) Patent No.: US 6,321,906 B1
(45) Date of Patent: Nov. 27, 2001

(54) QUAD-CELL AND SIX-CELL CARRIER CARTON WITH 2-PLY SEAL END BOTTOM AND METHOD OF MAKING SAME

(76) Inventor: Sam Wein, 3355 Genoa Way, Suite 128, Oceanside, CA (US) 92056

( * ) Notice: Subject to any disclaimer, the term of this patent is extended or adjusted under 35 U.S.C. 154(b) by 0 days.

(21) Appl. No.: 09/672,267

(22) Filed: Sep. 28, 2000

(51) Int. Cl.[7] ..... B65D 75/00; B65D 25/54

(52) U.S. Cl. ..... 206/198; 206/162; 206/170; 206/427; 206/781

(58) Field of Search ..... 206/141, 162, 206/165, 193, 198, 427, 170, 775, 781

(56) References Cited

U.S. PATENT DOCUMENTS

| | | | | |
|---|---|---|---|---|
| 2,395,711 | * | 2/1946 | Arnold | 206/198 |
| 2,738,871 | * | 3/1956 | Vander Luqt Jr. | 206/427 |
| 4,397,393 | * | 8/1983 | Pergande et al. | 206/775 X |
| 5,161,732 | * | 11/1992 | Clein et al. | 206/170 X |
| 5,499,712 | * | 3/1996 | Harrelson | 206/162 X |
| 5,518,110 | * | 5/1996 | Harrelson | 206/170 X |
| 5,547,074 | * | 8/1996 | Plaxico et al. | 206/162 X |
| 5,593,027 | * | 1/1997 | Sutherland | 206/198 X |
| 5,682,985 | * | 11/1997 | Plaxico et al. | 206/162 X |
| 5,947,367 | * | 9/1999 | Mikes et al | 206/427 X |

FOREIGN PATENT DOCUMENTS

| | | | | |
|---|---|---|---|---|
| 0560830 | * | 4/1949 | (GB) | 206/427 |

* cited by examiner

*Primary Examiner*—Byron P. Gehman
(74) *Attorney, Agent, or Firm*—Richard D. Clarke

(57) ABSTRACT

A container carrier carton construction for carrying a multiplicity of cylindrical objects is provided. The container carrier carton includes cut outs through which the advertising labels on the cylindrical objects within might be easily seen and read, a simple, elegant design for ease in manufacture, a reinforced bottom portion for safety in transporting objects within it and a design for blanks which would limit waste production during the manufacturing process. The cut out window portion allows the consumer to see the information on the label bearing portion of the cylindrical object held within the carton thus obviating the necessity of additional printing costs associated with duplication of the information on the carton. In addition, the construction of the carton incorporates the unused material from the cut-out window portion as a means to strengthen the structural integrity of the carton and provide a means by which the cylindrical objects are held securely in place. In addition, the blanks from which the cartons are manufacture are "nestable", thus reducing wasted carton materials significantly during the cutting process. Finally, the novel carton design provides a reinforced bottom for greater safety during transportation of the cylindrical objects which are often made from glass. The bottom is formed from four layers, or plies, of fibrous material, cardboard or similar appropriate material, thus providing structural reinforcement for the one of the portions of the carton which directly bears the greatest amount of weight.

16 Claims, 10 Drawing Sheets

QUAD-CELL AND SIX-CELL CARRIER CARTON WITH 2-PLY SEAL END BOTTOM AND METHOD OF MAKING SAME

BACKGROUND OF THE INVENTION

1. Field of the Invention

The present invention relates generally to fibrous carrier structures, and more particularly to a paperboard carton, container or box which has an improved structure for the display, storage and transport of several cylindrical objects such as bottles or cans.

2. Description of the Related Art

The container art field includes many different carrier structures designed to bold cylindrical objects for display, transport and storage. More specifically, these structures, or containers, are intended to protect the contents from falling out of the container and to provide discrete spaces for each object to prevent unwanted excessive movement during transport. In addition, these containers, typically in the form of cartons, are frequently meant to provide a means by which the contents of the carton may be identified. Many times, the design of these boxes use fibrous materials, such as cardboard, paper board, or corrugated construction. Examples of different types and kinds of devices for display, transport and storage of cylindrical objects in U.S. Pat. Nos. 5,657,864, 5,593,027, 5,332,091, and 4,549,650.

Naturally, some means are designed in to the carton to secure the cylindrical objects, which are often made of aluminum or glass, so that the objects are not inadvertently damaged or broken during transport. Just a few of the previous designs include cut out portions which allow the viewing of labels located on the objects within the carton. Although past box designs and attempts at accomplishing these objectives, none seem to have been able to accomplish both utilizing a simple, cost effective and efficient design.

Some carton designs are relatively expensive to manufacture because of the need for excess materials due to design demands or manufacturing complexity. Some designs, do not allow for a carton with reinforced bottom portions or quadruple reinforced handle portions to support the weight of heavy objects such as glass bottles filled with liquid. Therefore, the contents are subject to inadvertent damage. Most carton designs do not allow for cutouts or windows through which the labels and the content of the cylindrical objects may be viewed. This would allow potential consumers to readily view the contents of the cylindrical objects or the labels which provide necessary valuable information for informed purchase without necessitating duplication of printing processes which are costly and increase pollutants in the environment.

Therefore, it is clear that a need exists for an improved box design which provides for viewing of the label and content information on the cylindrical objects contained within it, has a reinforced bottom portion and quadruple reinforced handle portion to bear the weight of the contents of the carton, and is also easy and economical to manufacture.

One attempt to address these problems in the prior art is Harrelson, U.S. Pat. No. 5,657,864. This patent discloses a basket-style carrier containing openings in the side and end panels through which the lower portions of packaged articles can be seen. Unfortunately, the openings show only the bottom portions of the objects within the carrier and are not so positioned as to allow the expensive, attractive, information laden advertising label to be viewed by the potential consumer. Therefore, the manufacturer of the carton is required to reprint a redundant portion of the information on the carton itself thus adding to the cost of manufacture.

The carton design, although having some advantages over prior art, is a complex design compared to the present inventive carton. In addition, the design of the Harrelson carton necessarily generates much wasted material which increases manufacturing costs and places an additional load upon the environment by production of excessive waste materials. Finally, the Harrelson carton design also does not have other advantages of the present invention, namely the reinforced bottom portion which improves safety during transport.

Therefore, it would be highly desirable to have a new and improved device and method for making same for a carton with improved structure which would have a reinforced bottom portion for safety in transporting objects within it, provide for a cut out through which the advertising labels on the cylindrical objects within might be easily seen and read, provide a simple, elegant design for ease in manufacture and provide a design for blanks which would limit waste production during the manufacturing process.

The device described in U.S. Pat. No. 5,593,027 addresses the problem of a series of cutouts designed to display advertising labels on a cylindrical object contained within the article carrier. The design of the Sutherland device uses bottom panel flaps which fit into corresponding cutouts and hold the contents in by means of a locking tabs which might easily disengage or tear during transport since the major portion of the weight would be transferred to the neck of the tabs which represent a very small, relatively fragile portion of the bottom of the article carrier.

While the Sutherland design provides cells for two additional cylindrical objects, the handle portion which would bear the total weight of the objects is composed of two layers of material. Thus while providing additional weight, there is no provision provided to reinforce the portion of the carrier which would bear that additional weight during transport.

In addition, the article carrier requires a blank which would produce a large amount of wasted materials during manufacture.

Therefore, it would be highly desirable to have a new and improved device and method for making same for a carton with improved structure which would have a reinforced bottom portion and a quadruple reinforced handle portion for safety in transporting objects within it, and would provide a simple, elegant design for ease in manufacture and provide a blank design which would limit waste production during the manufacturing process.

U.S. Pat. No. 5,332,091 describes a beverage container carrier with a central panel formed from two identical blanks. While the upper portion of an advertising label on a cylindrical object may be seen above the individual cells forming the carrier, this necessarily means that a large portion of the object would protrude above the walls of the carrier, thus making it possible for the object to fall out of the carrier during transport.

In addition, the construction of the carrier requires that the bottom panel of the carrier be divided by a crease line and only a single layer of material. This means that the structural integrity of the bottom portion of the device might be compromised and that the objects within the carrier might fall through the bottom.

Additionally, the blank from which the carrier is constructed produces a considerable amount of waste materials thus adding to manufacturing costs and environmental load.

Therefore, it would be highly desirable to have a new and improved device and method for making same for a carton with improved structure which would have a reinforced bottom portion for safety in transporting objects within it, provide for a cut out through which the advertising labels on the cylindrical objects within might be easily seen and read and still hold the object securely in place and provide a simple, elegant design for ease in manufacture and provide a design for blanks which would limit waste production during the manufacturing process.

Finally, U.S. Pat. No. 4,549,650 describes an article carrier which addresses the problem of providing a reinforced bottom portion for safely transporting a number of cylindrical objects held within it. However, there is no cutout portion to allow the potential customer to view the advertising label. The major portion of the label would be obscured thus necessitating that the information on the labels must be reprinted on the carrier. While the handle portion is provided with a triple reinforced design, a quadruple reinforced handle portion would be more desirable when transporting cylindrical objects made from a heavy and fragile material such as glass.

In addition, the complexity of the carrier and the design of the blank would increase production costs and result in a great deal of waste during the manufacturing process which would make the device relatively expensive to manufacture.

Therefore, it would be highly desirable to have a new and improved device and method for making same for a carton with improved structure which would provide for a cut out through which the advertising labels on the cylindrical objects within might be easily seen and read, provide a simple, elegant design for ease in manufacture and provide a design for blanks which would limit waste production during the manufacturing process, and a quadruple reinforced handle portion for safety while transporting.

SUMMARY OF THE INVENTION

The above-mentioned difficulties and problems of the prior art are overcome by the present invention. Briefly stated, the present invention provides novel improvements to a carton for carrying a multiplicity of cylindrical objects which include cut outs through which the advertising labels on the cylindrical objects within might be easily seen and read, a simple, elegant design for ease and economy in manufacture, a reinforced bottom portion and a quadruple reinforced handle portion for safety in transporting objects within it and a design for blanks which would limit waste production during the manufacturing process.

Therefore, the principal object of the present invention is to provide a new and improved invention and method for making same, for a foldable carton for transporting, displaying and storing a multiplicity of cylindrical objects. This carton would allow for advertising labels with relevant information to be easily seen and read through cut outs in the carton for that purpose. This display of the advertising label would obviate the necessity of duplication of information on the carton itself, and thus reduce printing costs for the manufacturer.

More specifically, the portion which is cut out for the purposes of providing a viewing window is utilized as a structural component of the carton. This clever design provides structural integrity of the carton and a means by which the cylindrical objects are held securely in place. In addition, the use of this otherwise unused material for a dual purpose conserves on materials thus reducing manufacturing costs and load on the environment by reducing waste products during the manufacturing process.

It is a further object of the present invention to provide such a new and improved device and method for making same, carton for transporting, displaying and storing a multiplicity of cylindrical objects, with a simple, elegant design for ease in manufacture and which would provide a design for blanks that would limit waste production during the manufacturing process. This is accomplished by providing a simple, elegant design for blanks which are "nestable" during the manufacturing process. The unique blank design reduces the amount of waste produced during the manufacturing process significantly, thus reducing manufacturing costs and the load on the environment due to production of excessive waste materials.

Finally, it is yet a further object of the present invention to provide such a new and improved device and method for making same, for a carton for transporting, displaying and storing a multiplicity of cylindrical objects, which would also have built into the design, a reinforced bottom and a quadruple reinforced handle portion so as to provide for greater safety during the transportation of the objects which are often made of glass.

Even more specifically, the box has four elements which form the bottom panel. The bottom is formed from more than one layer, or plies, of fibrous material, cardboard or similar appropriate material. Similarly, the handle portion is comprised of four layers, thus providing structural reinforcement for the two portions of the carton which directly bear the greatest amount of weight.

These, and other features and advantages of the present invention are set forth more completely in the accompanying drawings and the following description.

BRIEF DESCRIPTION OF THE DRAWINGS

The above mentioned and other objects and features of this invention and the manner of attaining them will become apparent, and the invention itself will be best understood by reference to the following description of the embodiment of the invention in conjunction with accompanying drawings, wherein closely related elements have the same number but different alphabetical suffixes, and further wherein.

DESCRIPTION OF THE PREFERRED EMBODIMENTS

Figure 1:
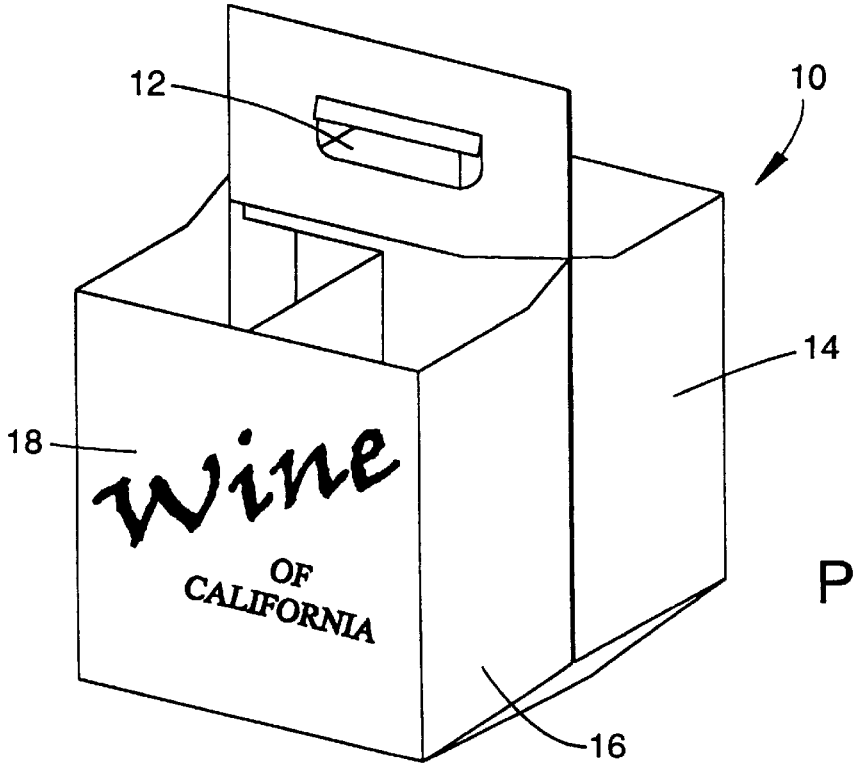
Fig. 1 Prior Art
FIG. 1 is a perspective view illustrating one example of a fully assembled prior art carrier carton construction for a quad-cell carrier carton.

Referring initially to FIG. 1, a perspective view of a prior art fully assembled four-cell container carrier 10, illustrating a two-ply handle 12, end panels 14 and 16, and label face panel 18.

Figure 2:
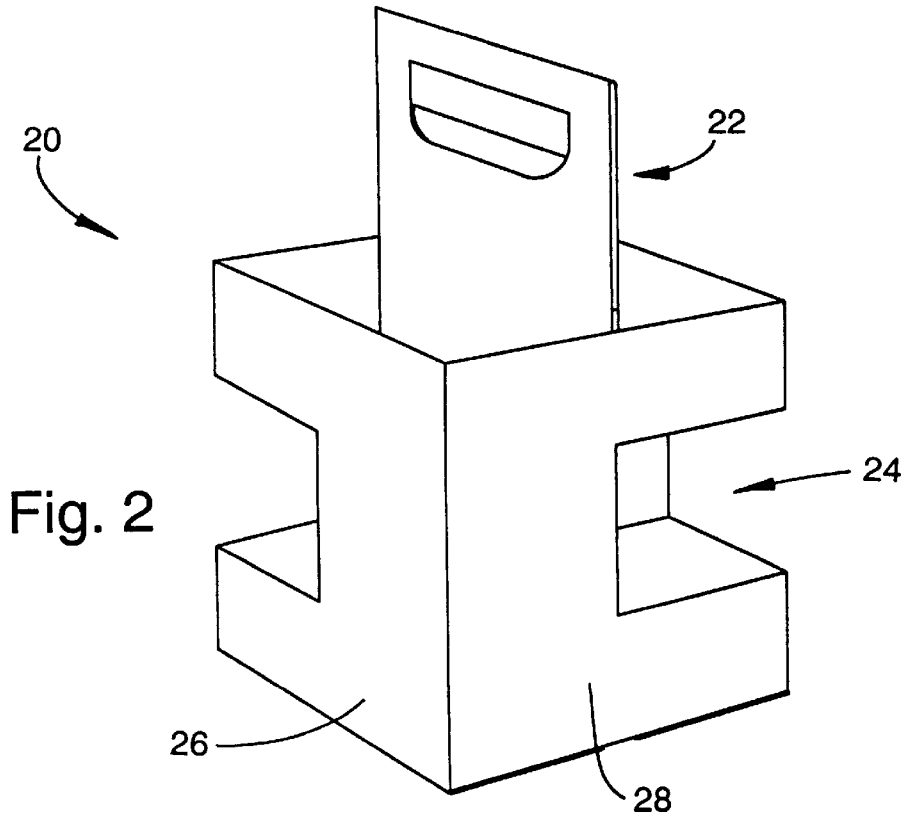
FIG. 2 is a perspective view of a fully assembled quad-cell carrier constructed in accordance with the present invention.

Referring now to FIG. 2, a perspective illustrating the fully assembled novel quad-cell container carrier 20 according to the present invention. The container carrier 20 is manufactured from a single piece of fibrous structure, such as cardboard, although other materials may be used. This novel invention provides a 4-ply construction integrated handle 22 to support the weight of the carrier and contents during transport. When assembled, the container carrier 20 has side panels as illustrated by side panels 26 and 28. A typical side panel 28 is shown with a unique container label display opening 24. The elegant design of this novel container carrier 20 allows the cut-away portion of the unique container label display opening 24 to fold inwardly to form part of the interior portion of the container cell.

Figure 3:
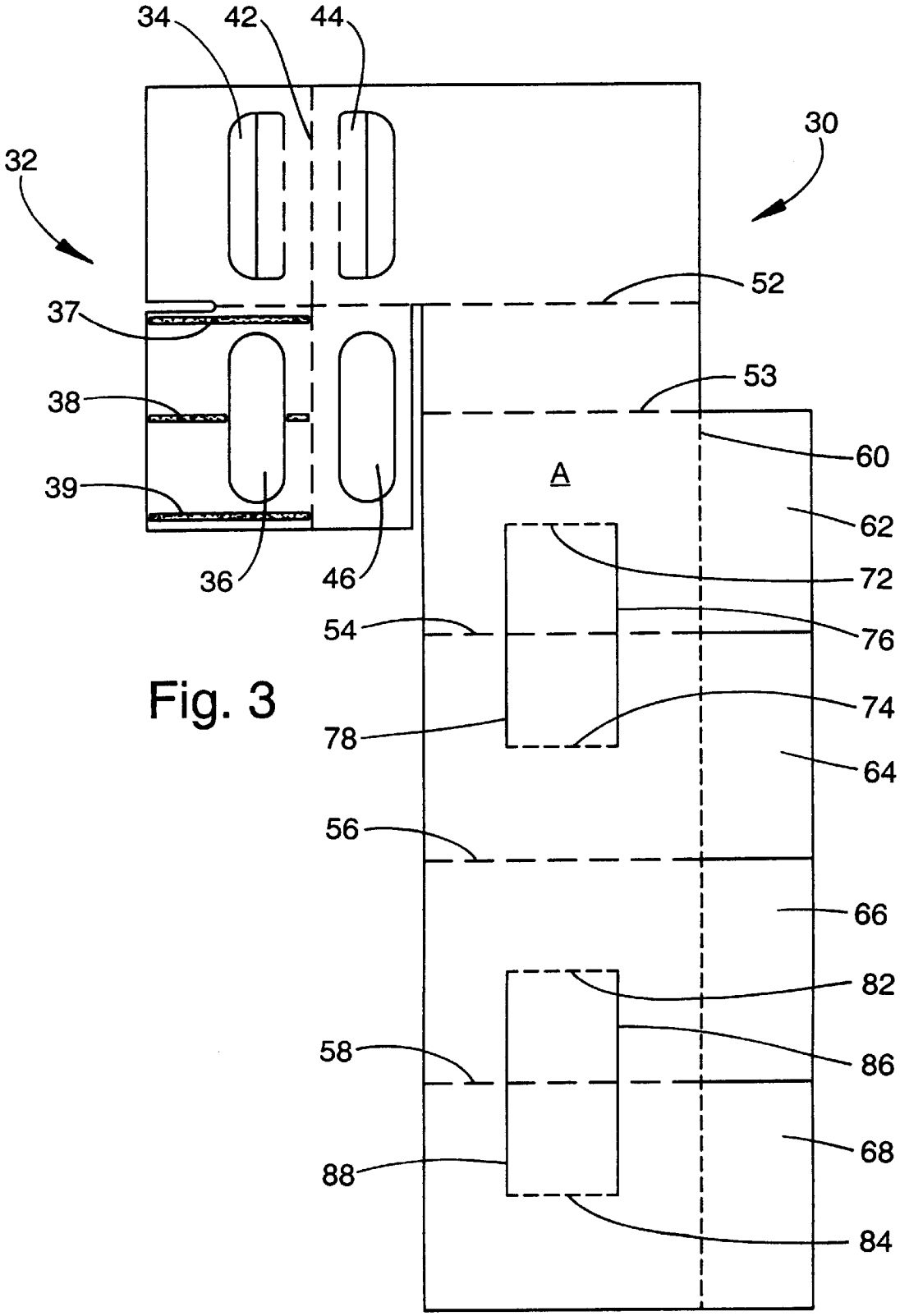
FIG. 3 is a schematic representation of a quad-cell carrier blank in a flat open position, illustrating the exterior surface of a quad-cell carrier scoring pattern, fold pattern, and glue pattern, constructed in accordance with the present invention.

Now referring to FIG. 3, a schematic representation of the quad-cell embodiment of the present invention is shown of an unfolded exterior side A 30 in a flat configuration, illustrating 4-ply handle panels 32. The handle openings 36 and 46 fold inwardly along perforated score line 52 to coincide with handle openings 34 and 44. The double layer of the 4-ply handle panels 32 is then folded inwardly a second time along 4-ply handle perforated fold 43. The layers are then secured by glue patterns 37, 38 and 39. The body of the container carrier are formed from a series of ninety degree folds along the perforated score lines 52, 53, 54, 56, and 58. The closure flaps 62, 64, 66, and 68 fold inwardly to form the reinforced bottom portion of the container carrier. The container label display opening cuts 76, 78, 86, and 88 fold inwardly along the container label display opening folds 72, 74, 82, and 84 to form a portion of the interior cell which secures the cylindrical object in place. Note that the closure flaps 62, 64, 66 and 68 are cut and scored such that they are all substantially the same dimension and in total area, thus, when glued and folded comprise a seal end bottom which is 2-ply in substantially entirely the total bottom area of the quad-cell carrier carton.

Figure 4:
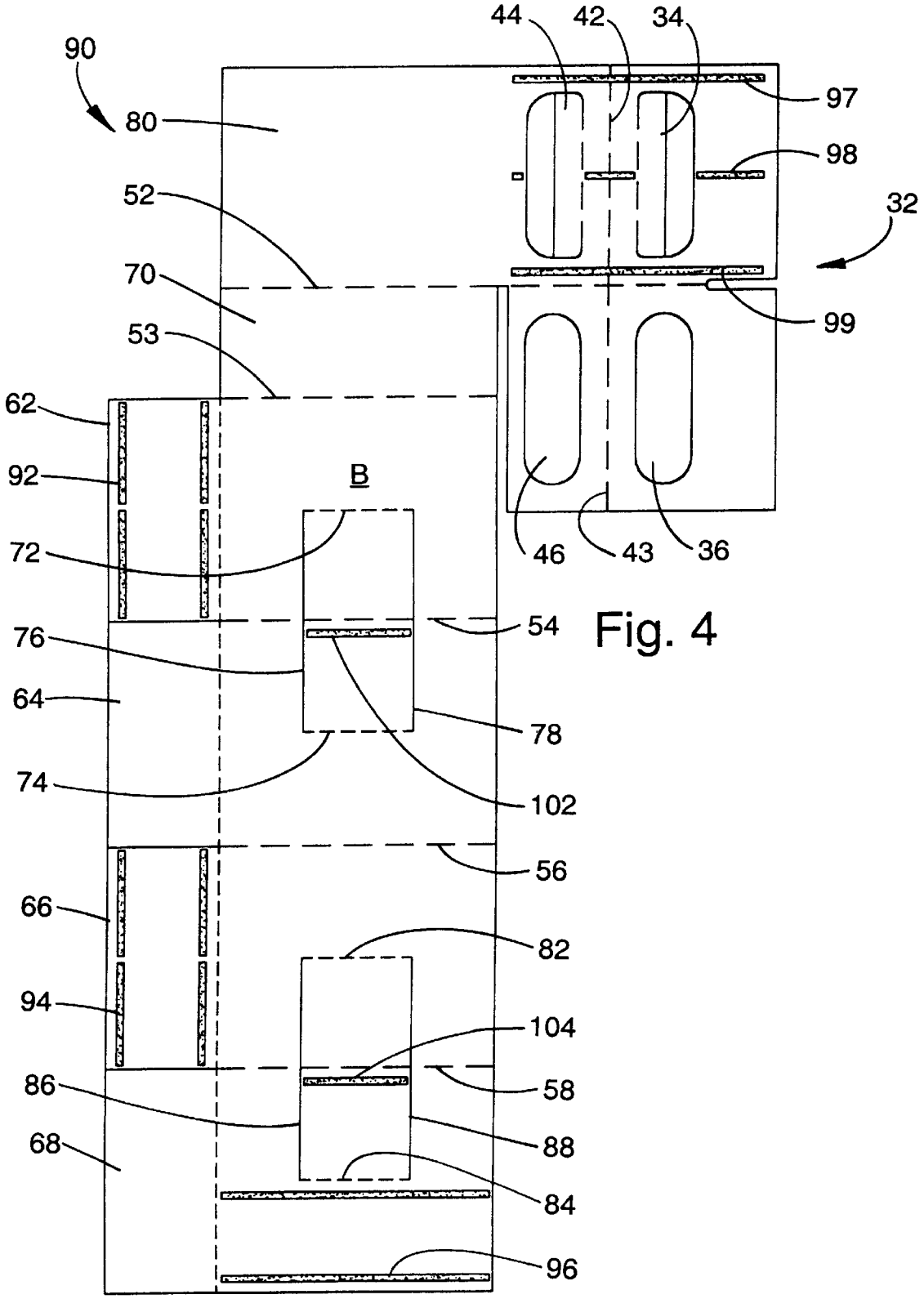
FIG. 4 is a schematic representation of a quad-cell carrier blank in a flat open position, illustrating the interior surface of a quad-cell carrier scoring pattern, fold pattern, and glue pattern, constructed in accordance with the present invention.

Referring now to FIG. 4, a schematic representation of an unfolded side of the interior unfolded side B 90 of a quad-cell embodiment of the present invention, when the handle openings 36 and 46 fold inwardly along perforated score line 52 to coincide with handle openings 34 and 44, the handle pattern glue patterns 97, 98 and 99 further secure the 4-ply handle panels 32 during the initial fold as described previously in FIG. 3. The side panel glue pattern 96 is secured to the side panel glue accepting portion 70 to complete the formation of the outer portion of the container carrier as described in FIG. 3. Additionally, closure flap glue patterns 92 and 94 are instrumental in securing the novel reinforced bottom portion of the container carrier as initially described in FIG. 3. Finally, display window glue patterns 102 and 104 secure the inwardly folded container label display opening cuts 76, 78, 86, and 88 to the handle support panel to complete the discrete cells which secure the cylindrical objects in place within the container carrier.

Figure 5:
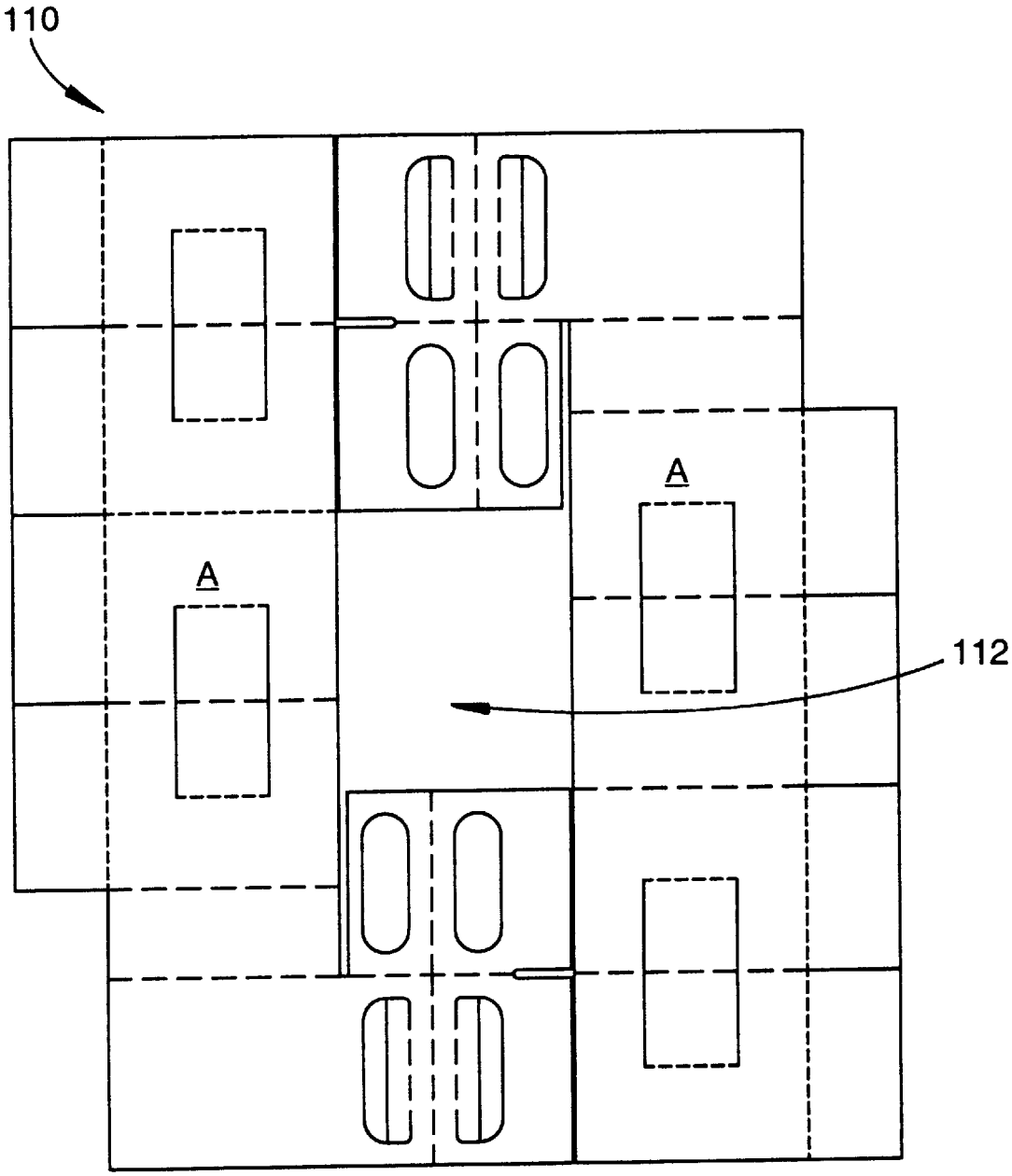
FIG. 5 is a schematic representation showing two of the quad-cell carrier blanks in a flat open position, illustrating the "nestable" feature of the blanks, constructed in accordance with the present invention.

Referring next to FIG. 5, a schematic representation showing two of the quad-cell container carriers in a flat open position as they would appear when initially cut from a single piece of fibrous structure such as paperboard. The nested carriers showing side A before cutting and folding 110 illustrates the material saving characteristics unique to the design of this preferred embodiment according to the present invention. The area of unused paperboard 112 is very limited in size and thus saves on material costs of production as well as waste recycling.

Figure 6:
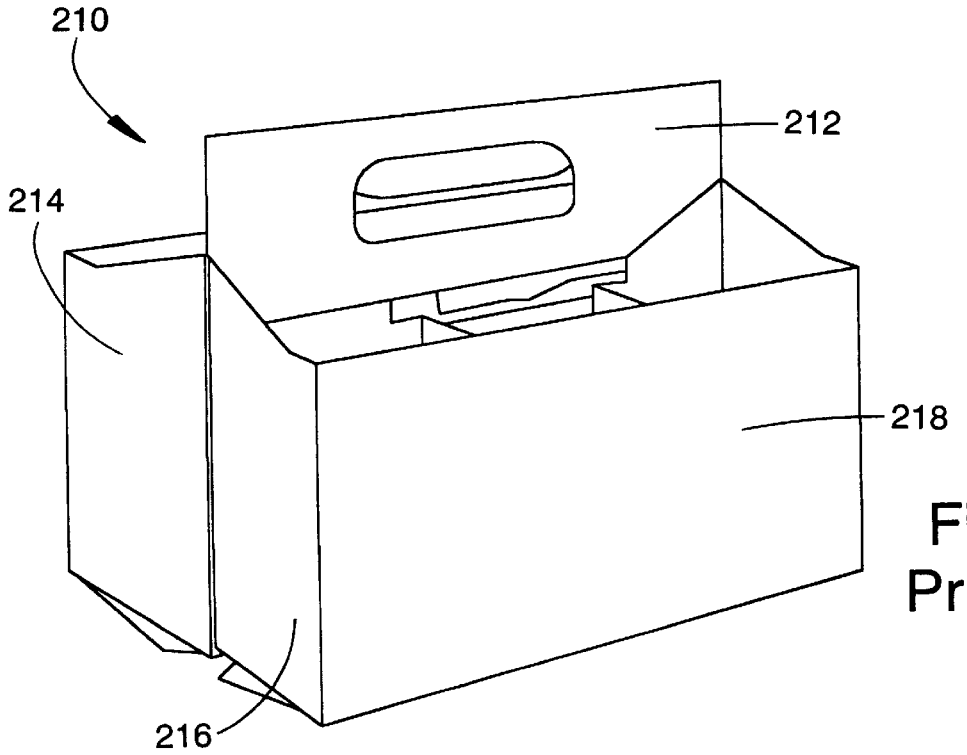
Fig. 6 Prior Art
FIG. 6 is a perspective view illustrating one example of a fully assembled prior art carrier carton construction for a six cell carrier carton.

Referring to FIG. 6, a perspective view of a prior art fully assembled six-cell container carrier 210, illustrating a two-ply handle 212, end panels 214 and 216, and label face panel 218.

Figure 7:
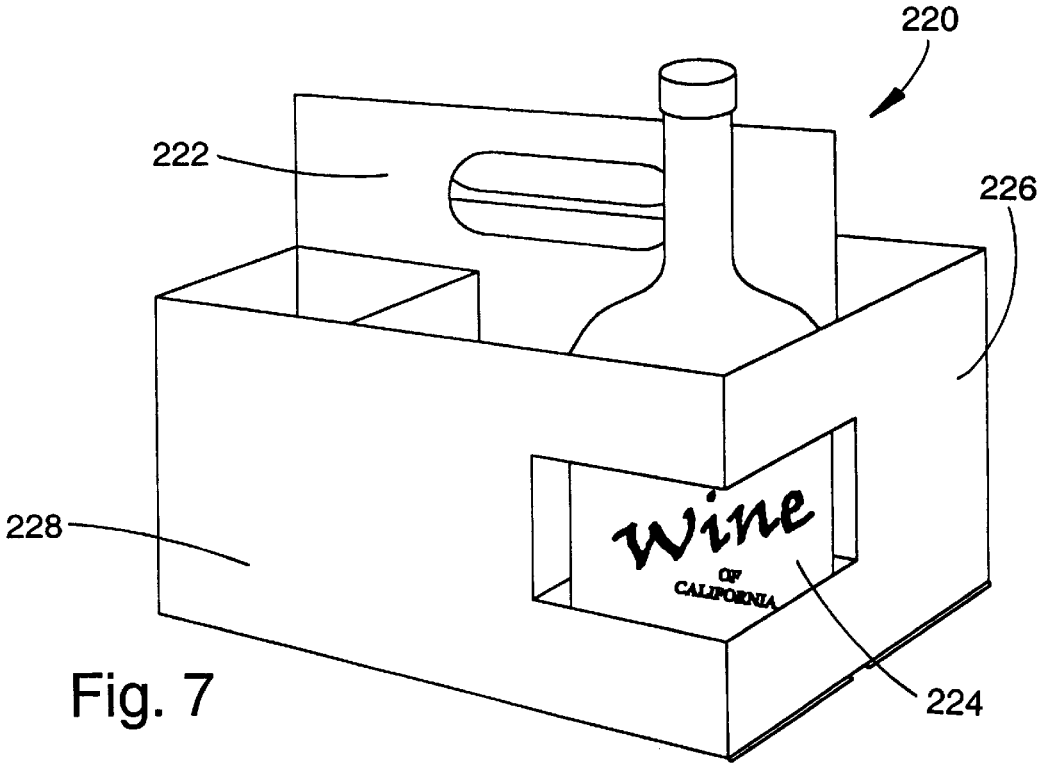
FIG. 7 is a perspective view of a fully assembled six cell carrier, constructed in accordance with the present invention.

Referring now to FIG. 7, a perspective illustrating the fully assembled novel six cell container carrier 220 according to the present invention. The container carrier 220 is manufactured from a single piece of fibrous structure, such as cardboard, although other materials may be used. This novel invention provides a 4-ply construction integrated handle 222 to support the weight of the carrier and contents during transport. When assembled, the container carrier 220 has side panels as illustrated by side panels 226 and 228. A typical side panel 228 is shown with a unique container label display opening 224. The elegant design of this novel container carrier 220 allows the cut-away portion of the unique container label display opening 224 to fold inwardly to form part of the interior portion of the container cell.

Figure 8:
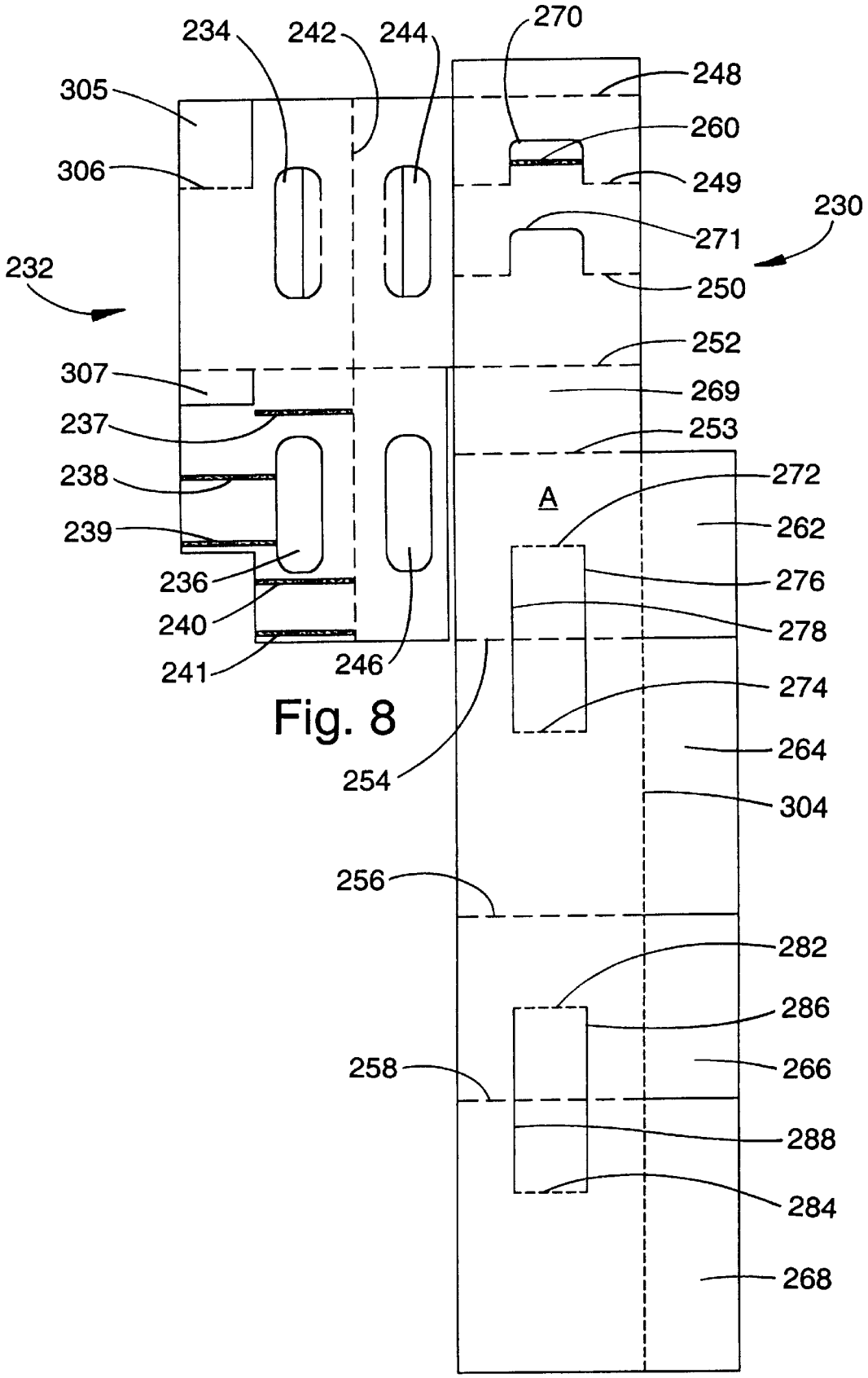
FIG. 8 is a schematic representation of a six cell carrier blank in a flat open position, illustrating the exterior surface of a six cell container carrier scoring pattern, fold pattern, and glue pattern, constructed in accordance with the present invention.

Now referring to FIG. 8, a schematic representation of the six cell embodiment of the present invention is shown of an unfolded exterior side A 230 in a flat configuration, illustrating 4-ply handle panels 232. The handle openings 236 and 246 fold inwardly along perforated score line 252 to coincide with handle openings 234 and 244. The double layer of the 4-ply handle panels 232 is then folded inwardly a second time along 4-ply handle perforated fold 242. The layers are then secured by glue patterns 237, 238, 239, 240 and 241. The body of the container carrier are formed from a series of ninety degree folds along the perforated score lines 252, 253, 254, 256, and 258. Part of the individual cells are formed from several ninety degree inward and outward folds of the end flap perforated score 248 and tab perforated scores 249 and 250. The closure flaps 262, 264, 266, and 268 fold inwardly to form the novel reinforced bottom portion of the container carrier. The container label display opening cuts 276, 278, 286, and 288 fold inwardly along the container label display opening folds 272, 274, 282, and 284 to form a portion of the interior cell which secure the cylindrical objects in place.

Continuing to refer to FIG. 8, a distinguishing feature of the six cell embodiment are the tab cuts 270 and 271. The tab glue pattern 260 located on tab cut 270 is secured to the back portion of the container label display opening cuts 286 and 288 which are folded inwardly along the container label display opening folds 282 and 284. Note that the closure flaps 262, 264, 266 and 268 are cut and scored such that closure flaps 262 and 266 are substantially two-thirds the total area of closure flaps 264 and 268, thus, when glued and folded comprise a seal end bottom which is 2-ply in substantially approximately two-thirds the total bottom area of the six-cell carrier carton.

Figure 9:
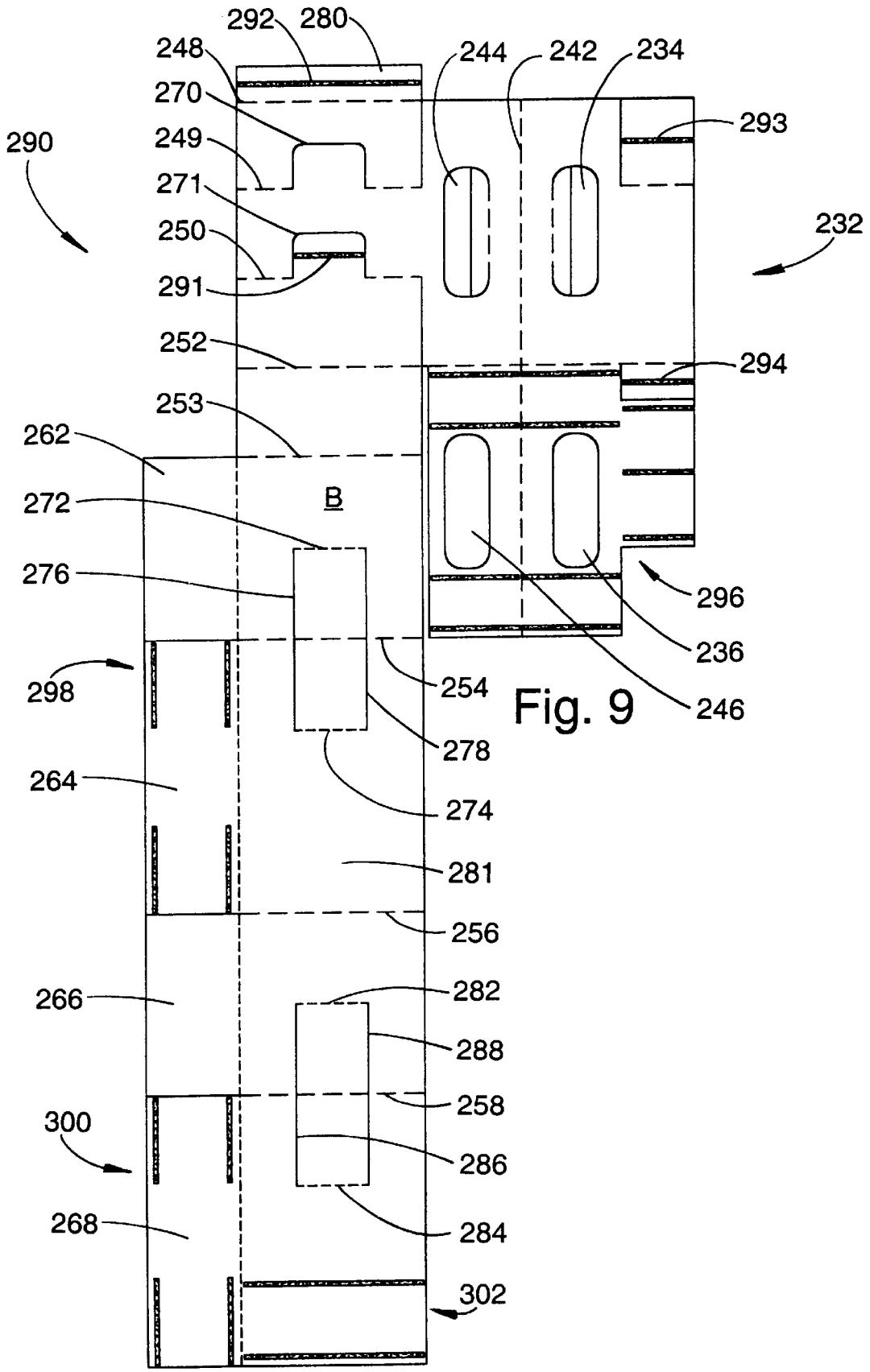
FIG. 9 is a schematic representation of a six cell carrier blank in a flat open position, illustrating the interior surface of a six cell container carrier scoring pattern and fold pattern and glue pattern, constructed in accordance with the present invention.

Referring now to FIG. 9, a schematic representation of an unfolded side of the interior unfolded side B 290 of a six cell embodiment of the present invention, when the handle openings 236 and 246 fold inwardly along perforated score line 252 to coincide with handle openings 234 and 244, the handle pattern glue pattern 296 further secure the 4-ply handle panels 232 during the initial fold as described previously in FIG. 8. The front panel glue pattern 302 is secured to the front panel glue accepting portion 269 illustrated in FIG. 8 to complete the formation of the outer portion of the container carrier as described in FIG. 8. Additionally, closure flap glue patterns 298 and 300 secure the closure flaps 262, 264, 266, and 268 together to form the reinforced bottom portion of the container carrier as initially described in FIG. 8. Tab glue pattern (Side B) 291 on tab cut 271 secures to the back portion of the container label display opening cuts 276 and 278 which are folded inwardly along the container label display opening folds 272 and 274. The end flap glue pattern 292 on the end flap 280 secures to the end flap glue pattern accepting portion 281 on one of the side panels. This forms one of the cells in the six cell embodiment of the current invention.

Figure 10:
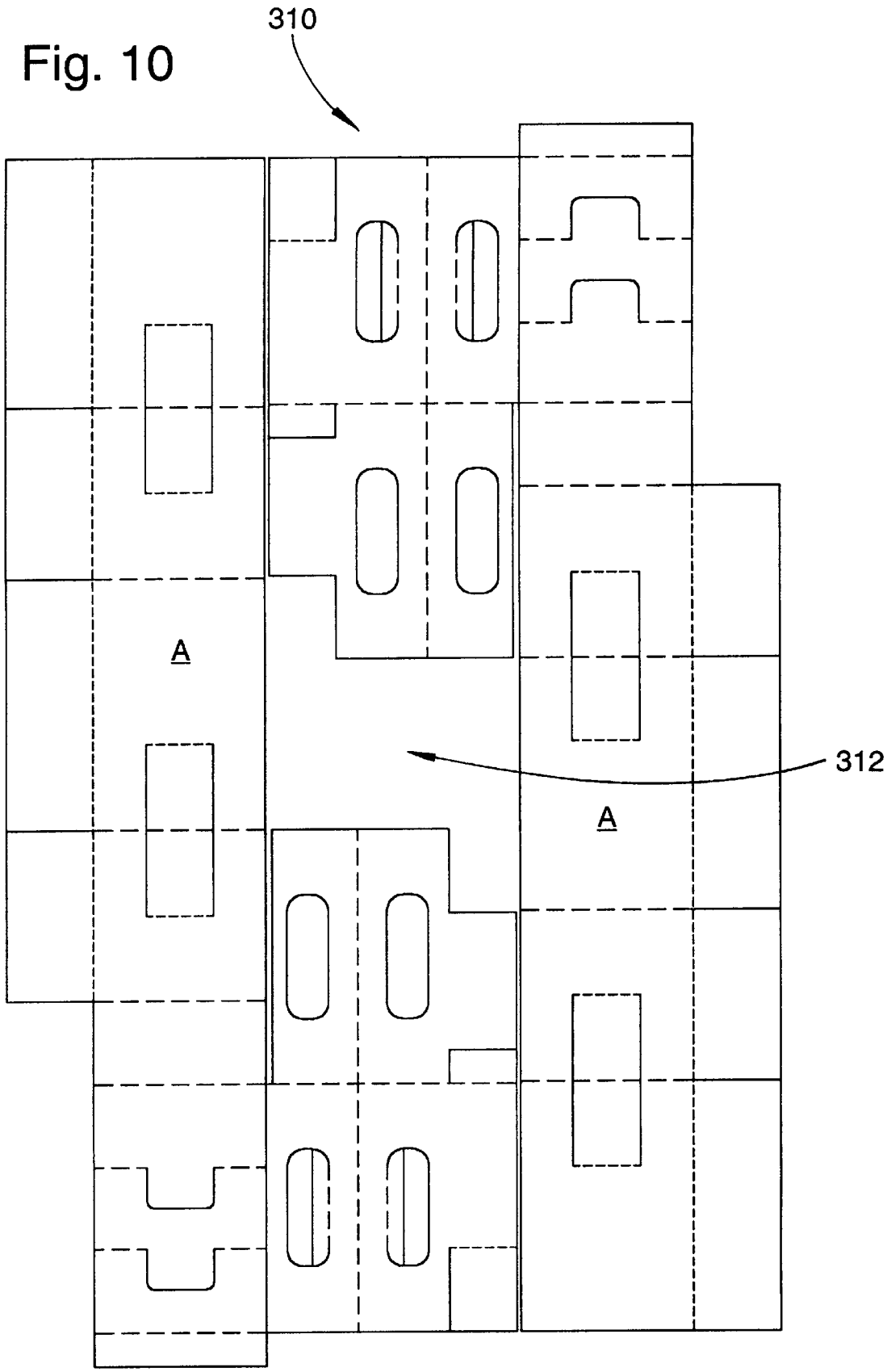
FIG. 10 is a schematic representation showing two of the six cell carrier blanks in a flat open position illustrating the "nestable" feature of the blanks, constructed in accordance with the present invention.

Referring next to FIG. 10, a schematic representation showing two of the six cell container carriers in a flat open position as they would appear when initially cut from a single piece of fibrous structure such as paperboard. The nested carriers showing side A before cutting and folding 310 illustrates the material saving characteristics unique to the design of this preferred embodiment according to the present invention. The area of unused paperboard 312 is very limited in size and thus saves on material costs of production as well as waste recycling.

Figure 11:
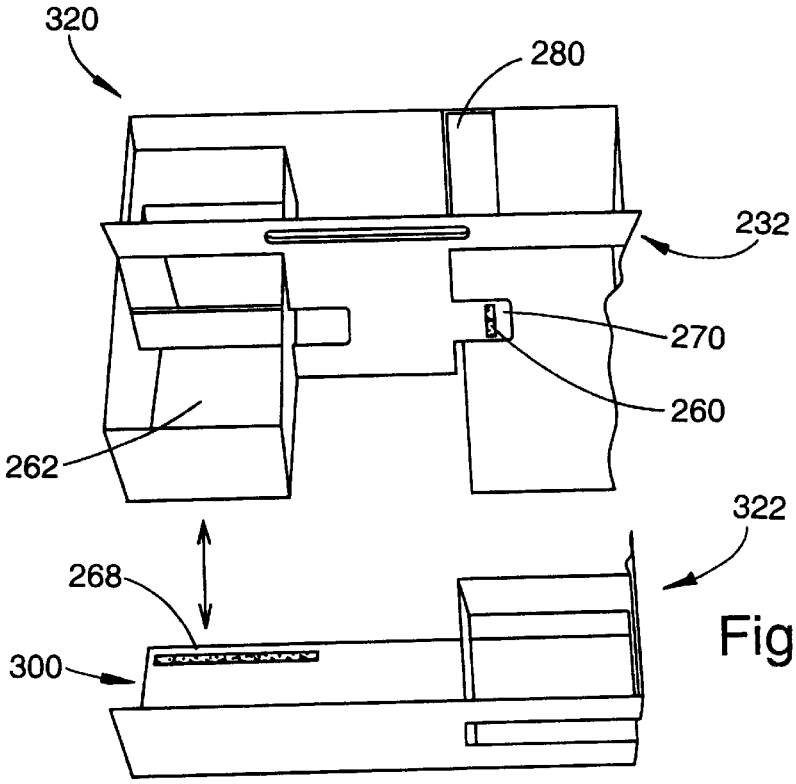
FIG. 11 is a partially cut-away exploded isometric view of a partially assembled six-cell carrier, constructed in accordance with the present invention.

Turning now to FIG. 11, a partially cut-away exploded isometric view of a six-cell container carrier 320 according to the present invention illustrating a partial assembly of the container, the end flap 280 and 4-ply handle panels 232 are shown as they would appear as part of an assembled container carrier. The tab glue pattern (Side A) 260 on the tab cut 270 is seen as it would secure to the back portion of the folded label display opening assembly 322. The closure flap glue pattern 300 on the closure flap 268 is illustrated as it would secure to the bottom portion of closure flap 262.

Figure 12:
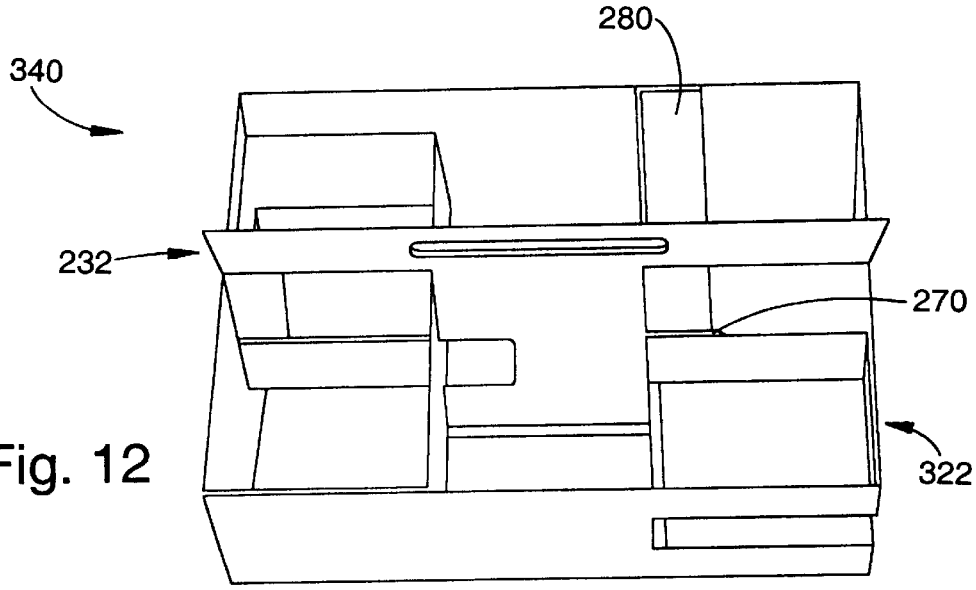
FIG. 12 is an isometric view of a fully assembled six-cell carrier, constructed in accordance with the present invention.

Referring to FIG. 12, a fully assembled isometric view of a six-cell container carrier 340 according to the present invention, showing the tab cut 270 secured to the back portion of the folded label display opening assembly 322.

Figure 13:
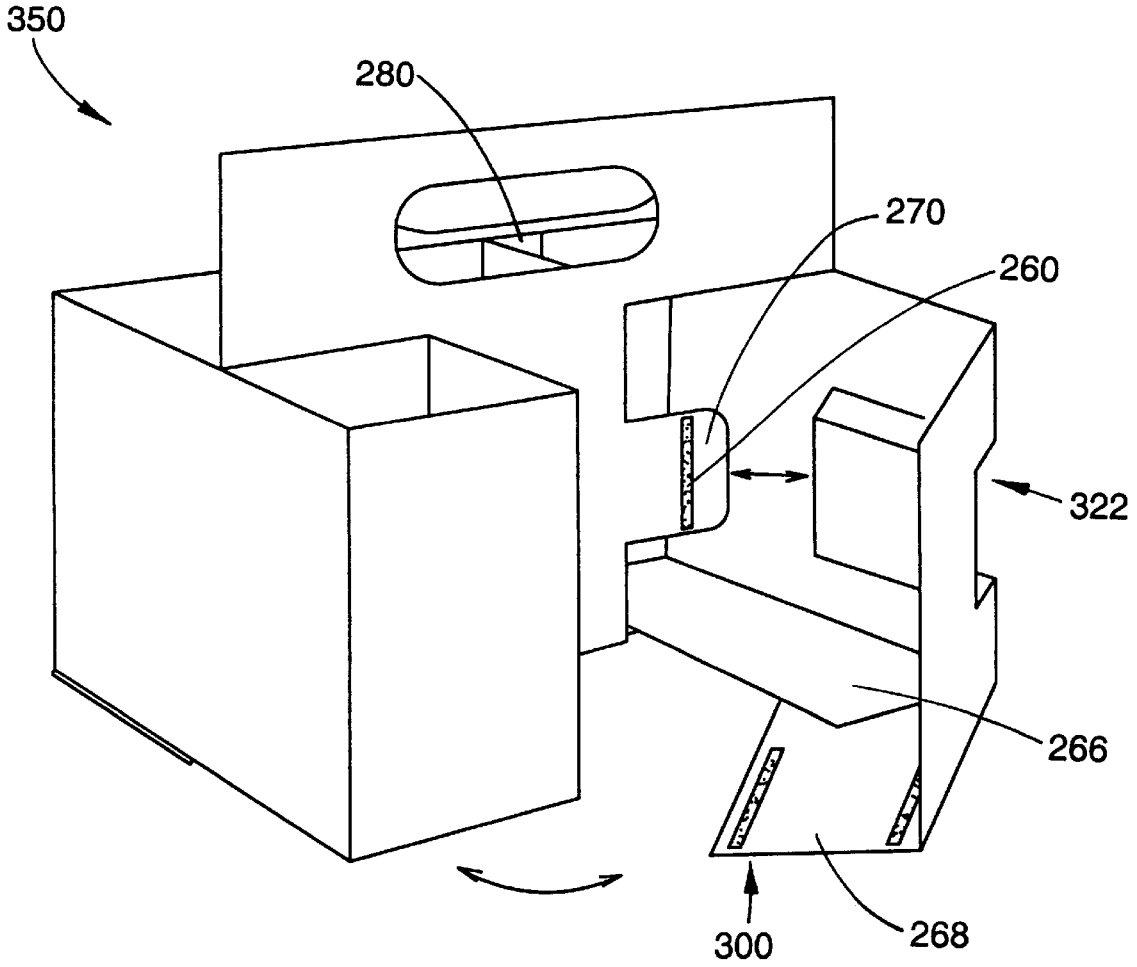
FIG. 13 ia a perspective view of partially assembled six-cell carrier carton, constructed in accordance with the present invention.

Finally referring to FIG. 13, a partially assembled perspective representation of a six-cell container carrier 350 according to the present invention which illustrates another view of the tab glue pattern (Side A) 260 on the tab cut 270 prior to securing to the back portion of the folded label display opening assembly 322. In addition, the closure glue pattern 300 on the closure flap 268 is illustrated as it would secure to the bottom portion of closure flap 266. Another view of the end flap 280 is also illustrated.

Method of Assembly

The method of assembling the container carrier 20 and 220 will now be more fully described than the description set forth above. A summary of the steps of the method or process include the following:

1. Fabricating a nested quad-cell 110 or six cell 310 pattern from a single side coated fibrous material such as paperboard
2. Scoring the material pattern
3. Applying a first glue pattern to unfolded coated side A of a quad-cell 30 or six-cell 230 container carrier carton
4. Applying a second glue pattern to unfolded uncoated side B of a quad-cell 90 or six-cell 290 container carrier carton
5. Folding the quad cell 20 or six cell 220 container carrier in a predetermined sequence
6. Inserting the cylindrical objects into the discrete cells of the container carrier for transport A further more detailed description of the assembly process is now given. The steps include the following:

1. Fabricating a nested quad-cell 110 or six cell 310 pattern from a single side coated fibrous material such as paperboard.

The patterns 110 and 310 are cut from a single side coated fibrous material such as paperboard where the coated side is side A and is used as the outer coated surface of the container carrier and the uncoated side is side B which is used as the inner surface of the container carrier. The patterns are nestable and provide an efficient and economic use of materials which results in very little waste product production as seen in the area of unused paperboard 112 and 312.

The quad-cell carrier comprise 4-ply handle panels 32 with 4-ply handle openings 34 and 36 foldably connected to side panels as exemplified by side panels 26 and 28. These in turn are foldably connected to closure flaps 62, 64, 66 and 68. The side panels as exemplified by side panels 26 and 28 have a cut out and foldable container label display opening as exemplified by container label display opening 72.

The six-cell carrier comprise 4-ply handle panels 232 with 4-ply handle openings 234 and 236 foldably connected to side panels as exemplified by side panel 226 and front panels as exemplified by front panel 228. These in turn are foldably connected to closure flaps 262, 264, 266 and 268. The side panel 226 and front panel 228 have a cut out and foldable container label display opening as exemplified by container label display opening 272.

2. Scoring the material pattern.

Scoring comprises perforations and folds. The quad-cell pattern perforation lines 42, 52, 53, 54, 56, and 58 and portions of the 4-ply handle openings 34 and 44.

The six-cell pattern perforation lines are 242, 248, 249, 250, 252, 253, 254, 256, and 258 and portions of the 4-ply handle openings 234 and 244. Fold lines on the quad-cell pattern are 72, 74, 82, 84 and 60. Fold lines on the six-cell pattern are 304, 272, 274, 282, 284 and 306.

3. Applying a first glue pattern to coated side A.

Glue patterns on unfolded coated side A of quad-cell carrier 30 are comprised of handle panel glue pattern 37, 38 and 39.

Glue patterns on unfolded side A of the six-cell carrier 230 comprise the handle panel glue pattern 237, 238, 239, 240 and 241 and the tab glue pattern 260.

4. Applying a second glue pattern to uncoated side B.

Glue patterns on unfolded uncoated side B 90 of quad-cell carrier consist of handle panel glue pattern 97, 98 and 99, display window glue patterns 102 and 104, closure flap glue patterns 92 and 94, and side panel glue pattern 96.

Glue patterns on unfolded uncoated side B 290 of the six-cell carrier comprise the tab glue pattern 291, end flap glue pattern 292, handle top glue pattern 293 and 294, the handle panel glue pattern 296, closure flap glue patterns 298 and 300 and the front panel glue pattern 302.

5. Folding the quad-cell container carrier carton 20, wherein the handle openings 36 and 46 fold inwardly along perforated score line 52 to coincide with handle openings 34 and 44. The double layer of the 4-ply handle panels 32 is then folded inwardly a second time along 4-ply handle fold 42 and 4-ply handle perforated fold 43. The body of the container carrier are formed from a series of ninety degree folds along the perforated score lines 52, 53, 54, 56, and 58. The closure flaps 62, 64, 66, and 68 fold inwardly to form the reinforced bottom portion of the container carrier. The container label display opening cuts 76,78,86, and 88 fold inwardly along the container label display opening folds 72,74, 82, and 84 to form a portion of the interior cell which secures the cylindrical object in place.

For the six-cell container carrier, the handle openings 236 and 246 fold inwardly along perforated score line 252 to coincide with handle openings 234 and 244. The double layer of the 4-ply handle panels 232 is then folded inwardly a second time along 4-ply handle perforated fold 242. The body of the container carrier are formed from a series of ninety degree folds along the perforated score lines 252, 253, 254, 256, and 258. A portion the individual cells are formed from several ninety degree inward and outward folds of the end flap perforated score 248 and tab perforated scores 249 and 250. The closure flaps 262, 264,266, and 268 fold inwardly to form the novel reinforced bottom portion of the container carrier. The container label display opening cuts 276,278,286, and 288 fold inwardly along the container label display opening folds 272, 274, 282, and 284 to form a portion of the interior cell which secures the cylindrical objects in place.

6. Inserting cylindrical objects such as cans or bottles into the discrete cells of the carrier carton for transport, storage and display.

The label display openings 24 and 224 on the assembled quad-cell 20 and six-cell 220 container carrier cartons are constructed so as to reveal the information on the labels of the cans or bottles contained within the discrete cells of the containers.

The present invention improves the construction and assembly of container carrier cartons, and thereby provides solutions to the many problems associated previously with box design and construction. Novel improvements have been clearly described to a carton providing for a 4-ply construction integrated handle, a reinforced bottom portion and a nestable blank which prevents material waste during the manufacturing process. Improvements to the carton also include a container label display opening. The cut out portion of the label display opening folds inwardly to form a discreet container cell and become an integral portion of the structure of the container carrier carton. No longer will the manufacturer bear the additional expense of duplicating printed information on container labels and container carrier carton. No longer will the manufacturer of the container carrier cartons have to bear additional expenses and environmental burden of wasted materials during the cutting of blanks for container carrier cartons. And no longer will the user be as frustrated with handles or bottoms of carrier cartons which are insufficient to bear the weight of the containers held within the cartons during transport and storage. The elegant, simple and efficient design saves raw materials, additional handling and expense during printing and manufacturing and provides unique improvements for safe handling during transport of possibly fragile containers.

Consequently, while the foregoing description has described the principle and operation of the present invention in accordance with the provisions of the patent statutes, it should be understood, however, that even though these numerous characteristics and advantages of the invention have been set forth in the foregoing description, together with details of the structure and function of the invention, the disclosure is illustrative only, and changes may be made in detail, especially in matters of shape, size, chemistry and arrangement of parts within the principal of the invention to the full extent indicated by the broad general meaning of the terms in which the appended claims are expressed.

What is claimed is:

1. A carrier carton for carrying four containers comprising:

(a) four side panels;

(b) four bottom panels substantially equal in total area to each other, which when folded, two of said bottom panels overlap the other two of said bottom panels in an area covering substantially the total area of the bottom dimensions of the carrier carton;

(c) four handle panels;

whereby when folded, a container display window is integrally formed at the corner of two of said side panels thereby allowing a consumer to directly view the label of a container carried within said carrier carton; and further wherein said bottom panels include glue patterns applied thereto such that when folded, said bottom panels form a sealed end bottom of the carrier carton.

2. A carrier carton according to claim 1, wherein said four handle panels are folded upon each other to form a 4-ply handle portion having enhanced strength.

3. A carrier carton according to claim 1, wherein said four bottom panels are folded upon each other to form a 2-ply carrier carton bottom portion having enhanced strength.

4. A carrier carton according to claim 1, wherein said four side panels, said four bottom panels, and said four handle panels are held in place when folded by hot glue melt patterns selectively placed upon at least one of said panels.

5. A carrier carton according to claim 1, wherein all of said panels are constructed from a blank having a coated side and an uncoated side.

6. A carrier carton for carrying six containers comprising, (a) two face label panels;

(b) two side panels;

(c) two inner tab panels;

(c) four bottom panels, which when folded, two of said bottom panels overlap the other two of said bottom panels in an area covering substantially approximately two-thirds of the total area of the bottom dimensions of the carrier carton; and (d) four handle panels;

whereby when said face label panels, side panels, handle panels and bottom panels are folded, a container display window is integrally formed at the corner of each of said face label and side panels thereby allowing a consumer to directly view the label of a container carried within said carrier carton; and further wherein said bottom panels include glue patterns applied thereto such that when folded, said bottom panels form a sealed end bottom of the carrier carton.

7. A carrier carton according to claim 6, wherein said four handle panels are folded upon each other to form a 4-ply handle portion having enhanced strength.

8. A carrier carton according to claim 6, wherein said four bottom panels are folded upon each other to form a substantially approximately two-thirds overlapping 2-ply carrier carton bottom portion having enhanced strength.

9. A carrier carton according to claim 6, wherein said two face label panels, said two side panels, said two inner tab panels, said four bottom panels, and said four handle panels are held in place when folded by hot glue melt patterns selectively placed upon at least one of said panels.

10. A carrier carton according to claim 6, wherein all of said panels are constructed from a blank having a coated side and an uncoated side.

11. A method of making a carrier carton comprising the steps of:

(a) providing a blank having two sides;

(b) fabricating an irregular material pattern from said two-sided blank;

(c) scoring said material pattern to form carrier carton panels;

(d) cutting said material pattern to form carrier carton panels;

(e) coating one side of said two-sided blank material pattern and leaving one side not coated, resulting in a coated side and a non-coated side;

(f) applying a first glue pattern to the coated side of said two-sided blank;

(g) applying a second glue pattern to uncoated side of said two-sided blank;

(h) folding said blank, wherein said carrier carton panels form a label display window;

whereby said carrier carton panels are folded to form a 4-ply handle portion having enhanced strength;

and further whereby said carrier carton panels are folded to form a 2-ply bottom portion having a bottom panel overlap of substantially two-thirds for a four container carton and substantially entirely for a six container carton, thereby providing a seal end bottom for the carrier carton bottom portion allowing greatly enhanced bottom holding strength.

12. The method of making a carrier carton according to claim 11, wherein in said steps of applying a first glue pattern to the coated side of said two-sided blank and applying a second glue pattern to the non-coated side of said two-sided blank, includes the use of hot melt glue to apply said glue patterns.

13. The method of making a carrier carton according to claim 11, wherein said step of scoring said material pattern includes the use of perforated scoring.

14. The method of making a carrier carton according to claim 11, wherein said step of fabricating an irregular material pattern from a two-sided blank includes the step of fabricating said two-sided blank such that the material pattern is oppositely nested to allow the use of less material and decrease wasted material.

15. The method of making a carrier carton according to claim 11, wherein said step (e) applying a first glue pattern to the coated side of said two-sided blank, and step (e) applying a second glue pattern to uncoated side of said two-sided blank, are performed simultaneously.

16. The method of making a carrier carton according to claim 11, wherein said step (b) scoring said material pattern to form carrier carton panels, and step (c) cutting said material pattern to form carrier carton panels, is performed such that said material pattern is oppositely nested to allow the use of less material and decrease wasted material.

* * * * *